US011254125B2

(12) United States Patent
Okubo et al.

(10) Patent No.: US 11,254,125 B2
(45) Date of Patent: Feb. 22, 2022

(54) LIQUID DISCHARGING HEAD UNIT AND LIQUID DISCHARGING APPARATUS

(71) Applicant: Seiko Epson Corporation, Tokyo (JP)

(72) Inventors: Katsuhiro Okubo, Azumino (JP); Nobuaki Ito, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/005,428

(22) Filed: Aug. 28, 2020

(65) Prior Publication Data

US 2021/0060945 A1 Mar. 4, 2021

(30) Foreign Application Priority Data

Aug. 29, 2019 (JP) ..... JP2019-156413

(51) Int. Cl.
*B41J 2/14* (2006.01)

(52) U.S. Cl.
CPC ..... *B41J 2/14145* (2013.01); *B41J 2/14201* (2013.01); *B41J 2002/14403* (2013.01)

(58) Field of Classification Search
CPC ..... B41J 2/14145; B41J 2/14201; B41J 2002/14403; B41J 2002/14419; B41J 2202/12; B41J 2202/20; B41J 2/01; B41J 2/14; B41J 2/175; B41J 2/17563
See application file for complete search history.

(56) References Cited

FOREIGN PATENT DOCUMENTS

JP 2013224007 A * 10/2013 ..... B41J 2/1625
JP 2017-136720 A 8/2017

OTHER PUBLICATIONS

IP.com search (Year: 2021).*

* cited by examiner

*Primary Examiner* — Lisa Solomon
(74) *Attorney, Agent, or Firm* — Harness, Dickey & Pierce, P.L.C.

(57) ABSTRACT

A first flow path is provided between the first layer and the second layer, a second flow path is provided between the second layer and the third layer, a filter chamber is provided inside the third layer, and the second layer is thinner than each of the first layer and the third layer.

12 Claims, 14 Drawing Sheets

LIQUID DISCHARGING HEAD UNIT AND LIQUID DISCHARGING APPARATUS

The present application is based on, and claims priority from JP Application Serial Number 2019-156413, filed Aug. 29, 2019, the disclosures of which are hereby incorporated by reference here in their entirety.

BACKGROUND

1. Technical Field

The present disclosure relates to a liquid discharging apparatus.

2. Related Art

In the related art, a liquid discharging apparatus that discharges a liquid such as ink is known, as represented by an ink jet type printer. For example, the apparatus described in JP-A-2017-136720 has a liquid ejecting portion that ejects ink from a plurality of nozzles, and a flow path unit in which a flow path that supplies the ink to the liquid ejecting portion is formed.

A flow path member used in the above-described flow path unit is constituted by, for example, a plurality of laminated layers in which flow paths are provided between layers. In the flow path member having such a laminated structure, it is desired to reduce the overall thickness of the flow path member without causing other adverse effects as much as possible.

SUMMARY

According to an aspect of the present disclosure, there is provided a liquid discharging head unit including: a flow path member formed by laminating a plurality of layers and through which a liquid flows; and a liquid discharging head that is supplied with the liquid from the flow path member and discharges the liquid, in which the plurality of layers include a first layer that is an outermost layer among the plurality of layers in a laminating direction, a second layer that is laminated on the first layer, and a third layer that is laminated on the second layer on a side opposite to the first layer, a first flow path is provided between the first layer and the second layer, a second flow path is provided between the second layer and the third layer, a filter chamber is provided inside the third layer, and the second layer is thinner than each of the first layer and the third layer.

DESCRIPTION OF EXEMPLARY EMBODIMENTS

Figure 2:
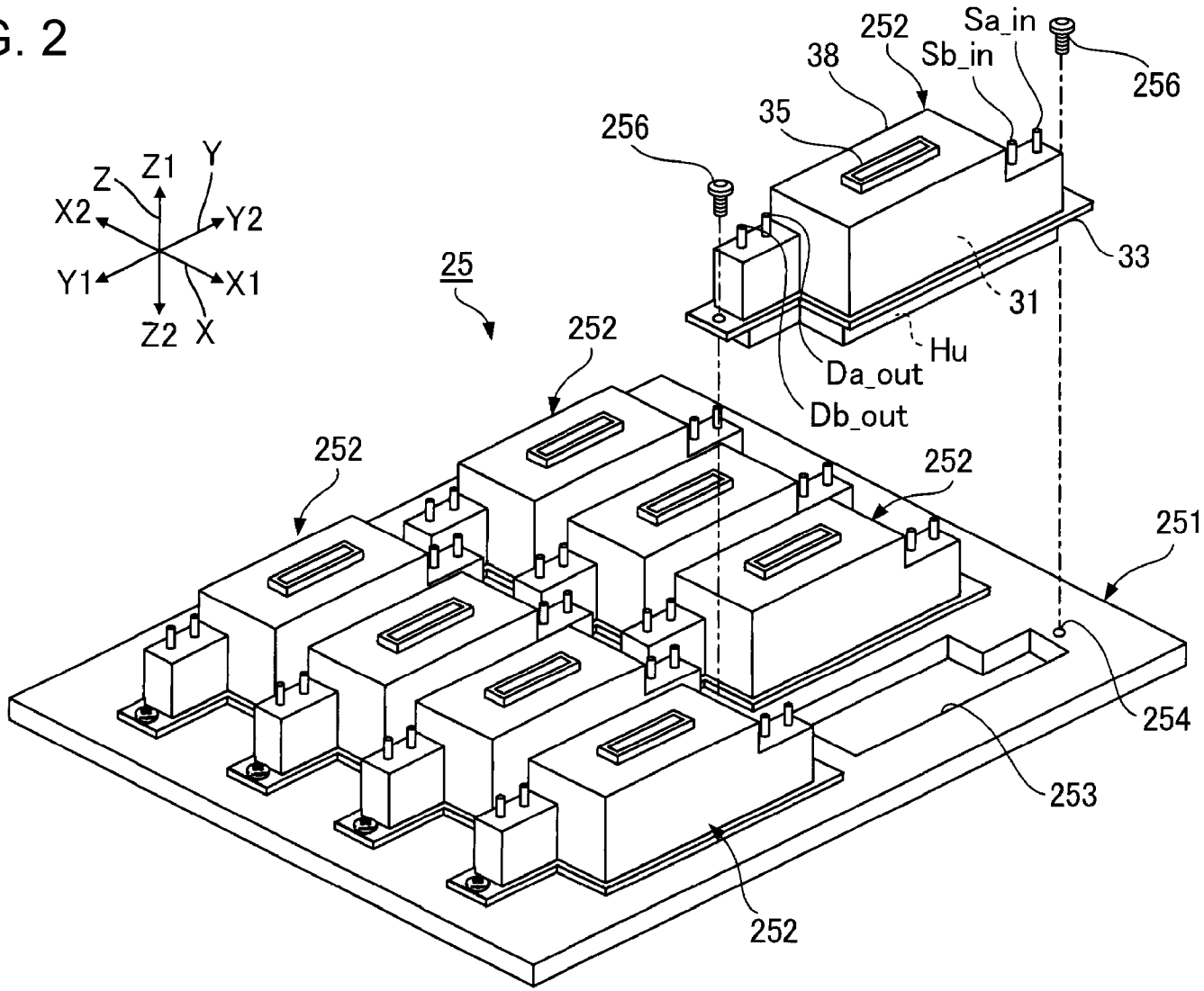
FIG. 2 is a perspective view of a head module.

In the following description, an X axis, a Y axis, and a Z axis that are orthogonal to each other are assumed. As illustrated in FIG. 2, a direction along the X axis when viewed from any point is represented as an X1 direction, and a direction opposite to the X1 direction is represented as an X2 direction. Similarly, directions opposite to each other along the Y axis from any point are represented as Y1 and Y2 directions, and directions opposite to each other along the Z axis from any point are represented as Z1 and Z2 directions. An X-Y plane including the X axis and the Y axis corresponds to a horizontal plane. The Z axis is an axis along the vertical direction, and the Z2 direction corresponds to a lower side in the vertical direction. The X axis, the Y axis, and the Z axis may intersect each other at an angle of substantially 90 degrees.

1. First Embodiment

1-1. Liquid Discharging Apparatus 100

Figure 1:
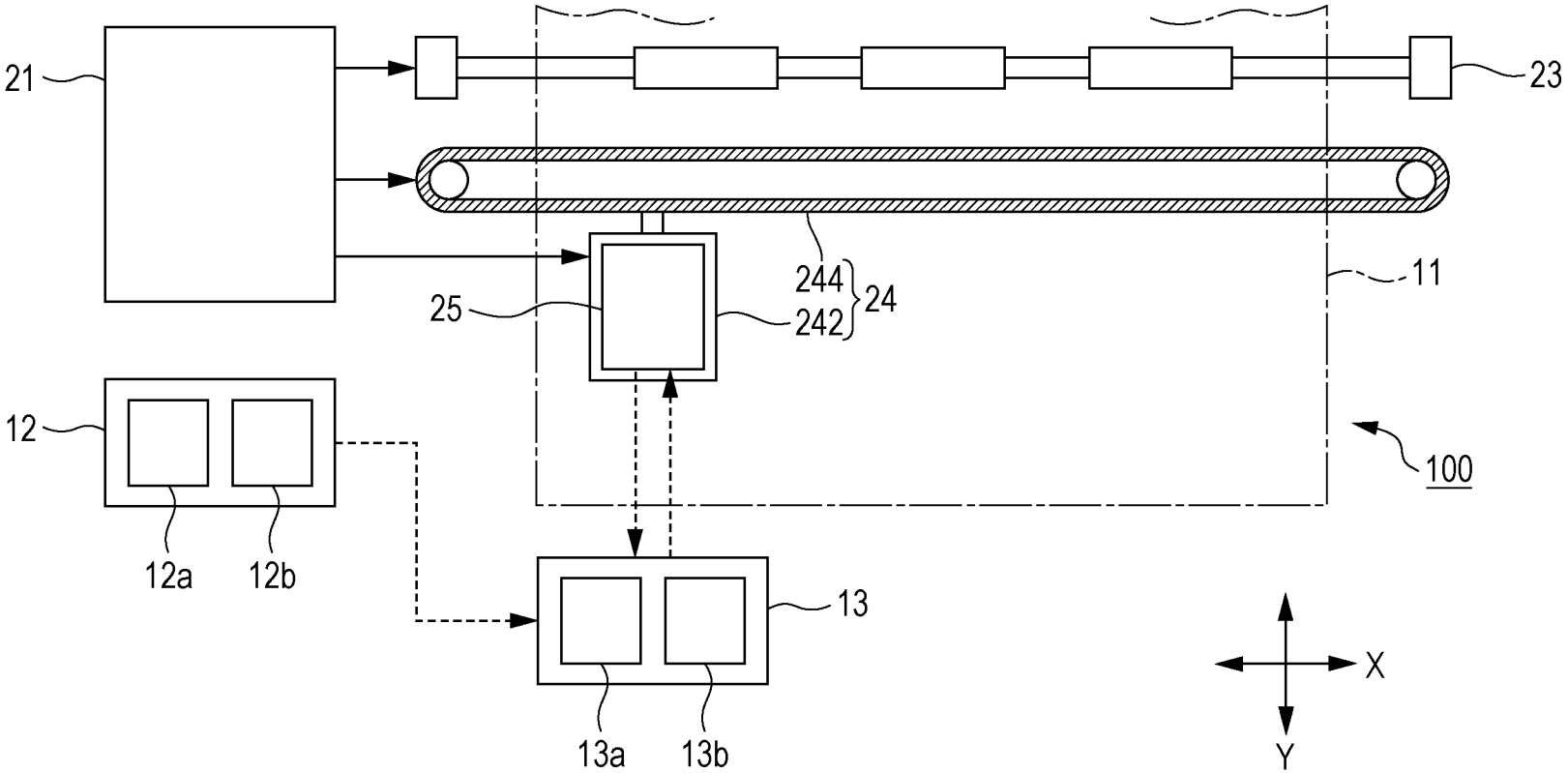
FIG. 1 is a schematic view illustrating a configuration of a liquid discharging apparatus according to a first embodiment.

FIG. 1 is a schematic view illustrating a configuration of a liquid discharging apparatus 100 according to a first embodiment. The liquid discharging apparatus 100 is an ink jet type printing apparatus that discharges ink, which is an example of a liquid, as droplets onto a medium 11. The medium 11 is typically a printing paper. However, a printing target made of any material such as a resin film or cloth may be used as the medium 11, for example.

As illustrated in FIG. 1, the liquid discharging apparatus 100 is provided with a liquid container 12 that stores the ink. For example, a cartridge that is attachable to and detachable from the liquid discharging apparatus 100, a bag-shaped ink pack made of a flexible film, or an ink tank that can be replenished with ink is used as the liquid container 12. As illustrated in FIG. 1, the liquid container 12 includes a liquid container 12*a* and a liquid container 12*b*. A first ink is stored in the liquid container 12*a*, and a second ink is stored in the liquid container 12*b*. The first ink and the second ink are different types of ink. For example, one of the cyan ink, the magenta ink, the yellow ink, and the black ink is used as the first ink, and the other one is used as the second ink.

The liquid discharging apparatus 100 is provided with a sub tank 13 that temporarily stores ink. The ink supplied from the liquid container 12 is stored in the sub tank 13. The sub tank 13 includes a sub tank 13*a* that stores the first ink and a sub tank 13*b* that stores the second ink. The sub tank 13*a* is coupled to the liquid container 12*a*, and the sub tank 13*b* is coupled to the liquid container 12*b*. Further, the sub tank 13 is coupled to a head module 25, supplies ink to the head module 25, and collects the ink from the head module 25. The flow of the ink between the sub tank 13 and the head module 25 will be described in detail later.

As illustrated in FIG. 1, the liquid discharging apparatus 100 includes a control unit 21, a transporting mechanism 23, a moving mechanism 24, and the head module 25. The control unit 21 controls each element of the liquid discharging apparatus 100. The control unit 21 includes, for example, one or a plurality of processing circuits such as a central processing unit (CPU) or a field programmable gate array (FPGA), and one or a plurality of storage circuits such as a semiconductor memory.

The transporting mechanism 23 transports a medium 11 along the Y axis under the control of the control unit 21. The moving mechanism 24 causes the head module 25 reciprocates along the X axis under the control of the control unit 21. The moving mechanism 24 according to the present embodiment includes a substantially box-shaped transporting body 241 that accommodates the head module 25, and an endless belt 242 to which the transporting body 241 is fixed. The liquid container 12 and the sub tank 13 may be mounted on the transporting body 241 together with the head module 25.

The head module 25 discharges the ink which is supplied from the sub tank 13, from each of a plurality of nozzles onto the medium 11 under the control of the control unit 21. The head module 25 discharges the ink onto the medium 11 in parallel with the transport of the medium 11 by the transporting mechanism 23 and the repeated reciprocation of the transporting body 241, thereby an image is formed on a surface of the medium 11.

FIG. 2 is a perspective view of the head module 25. As illustrated in FIG. 2, the head module 25 includes a support body 251 and a plurality of head units 252. The support body 251 is a plate-shaped member that supports the plurality of head units 252. A plurality of mounting holes 253 and a plurality of screw holes 254 are formed in the support body 251. Each head unit 252 is supported by the support body 251 in a state inserted into the mounting hole 253. The plurality of screw holes 254 are provided in twos in correspondence with each of the mounting holes 253. As illustrated in FIG. 2, each head unit 252 is fixed to the support body 251 by screwing using screws 256 and screw holes 254 at two places. The plurality of head units 252 are arranged in a matrix-shaped along the X axis and the Y axis. However, the number of head units 252 and the aspect of the arrangement of the plurality of head units 252 are not limited to the above examples.

As described above, the liquid discharging apparatus 100 has the head unit 252, which is an example of the liquid discharging head unit, and the control unit 21, which is an example of a control portion that controls a discharging operation from the head unit 252. In the liquid discharging apparatus 100 described above, by obtaining the effect that the overall thickness of the flow path member 311 described later can be reduced, it is possible to obtain the effect of increasing the degree of freedom in design or the like.

1-2. Head Unit 252

Figure 3:
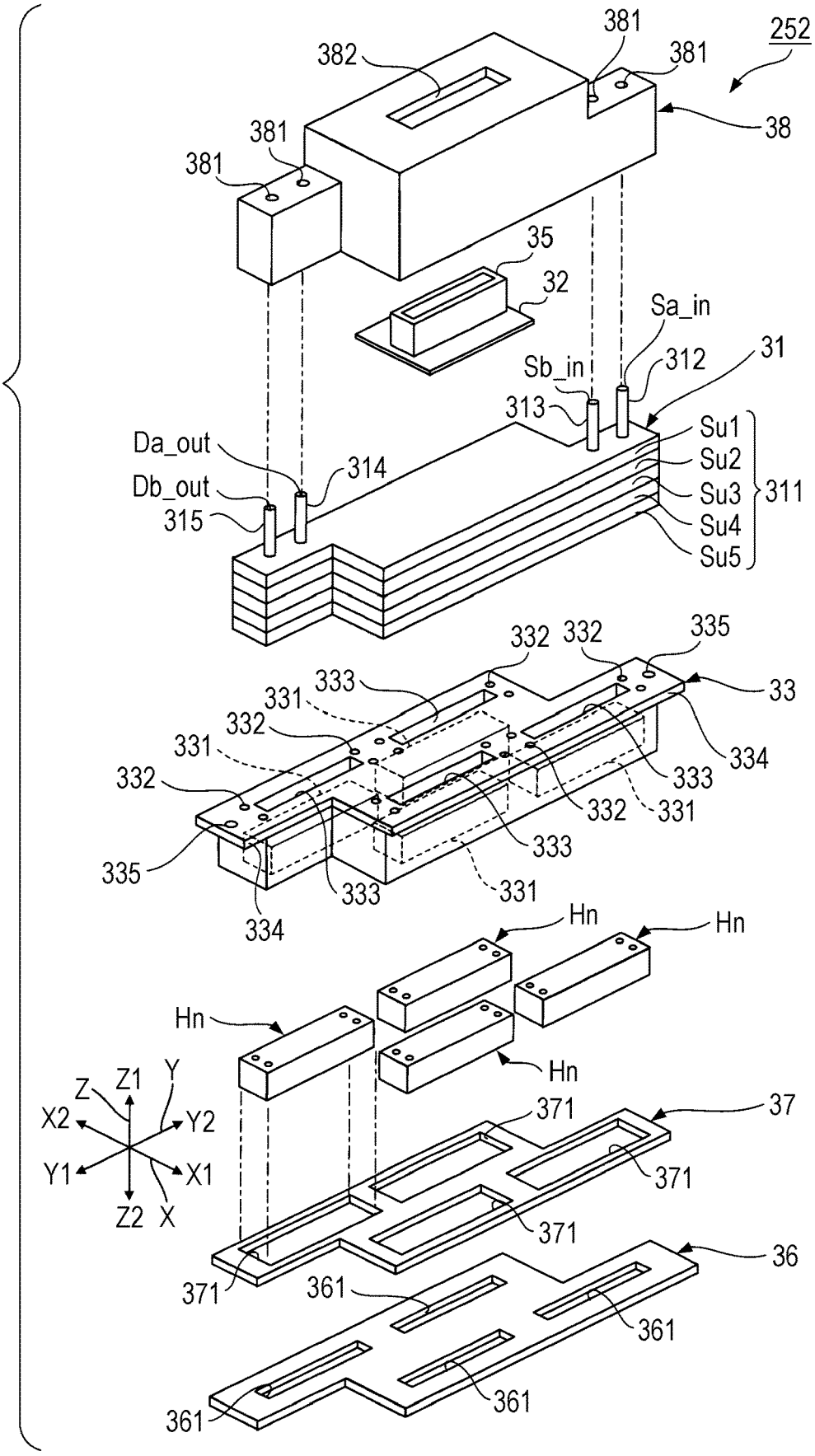
FIG. 3 is a disassembled perspective view of a head unit.

FIG. 3 is a disassembled perspective view of the head unit 252. As illustrated in FIG. 3, the head unit 252 includes a flow path structure 31, a wiring substrate 32, a holder 33, a plurality of circulation heads Hn, a fixing plate 36, a reinforcing plate 37, and a cover 38. The flow path structure 31 is positioned between the wiring substrate 32 and the holder 33. Specifically, the holder 33 is installed in the Z2 direction with respect to the flow path structure 31, and the wiring substrate 32 is installed in the Z1 direction with respect to the flow path structure 31. The circulation head Hn is an example of a "liquid discharging head". Further, among the plurality of circulation heads Hn, any one circulation head Hn is an example of a "first liquid discharging head", and any other one circulation head Hn is an example of a "second liquid discharging head". In the present embodiment, the number of circulation heads Hn provided in each head unit 252 is four. In the following, these four circulation heads Hn are also referred to as circulation heads H1, H2, H3, and H4.

The flow path structure 31 is a structure having therein a flow path for supplying the ink stored in the sub tank 13 to the plurality of circulation heads Hn. The flow path structure 31 includes a flow path member 311 and coupling pipes 312, 313, 314, and 315. Although not shown in FIG. 3, the flow path member 311 is provided with a supply flow path for supplying the first ink to the plurality of circulation heads Hn, a supply flow path for supplying the second ink to the plurality of circulation heads Hn, an exhaust flow path for exhausting the first ink from the plurality of circulation heads Hn, and an exhaust flow path for exhausting the second ink from the plurality of circulation heads Hn.

The flow path member 311 is constituted by laminating a first layer Su1, a second layer Su2, a third layer Su3, a fourth layer Su4, and a fifth layer Su5. The plurality of layers Su1 to Su5 constituting the flow path member 311 are formed by injection molding of a resin material, for example. The plurality of layers Su1 to Su5 are bonded to each other by, for example, an adhesive. As will be described later, in the flow path member 311 according to the present embodiment, the thicknesses of the first layer Su1, the second layer u2, the third layer Su3, the fourth layer Su4, and the fifth layer Su5 along the Z axis are actually different from each other. However, in FIG. 3, these thicknesses are substantially the same as each other for convenience.

The flow path member 311 has a longitudinal shape along the Y axis. Coupling pipes 312 and 313 are provided in a part at one end of the flow path member 311 in the longitudinal direction. On the other hand, coupling pipes 314 and 315 are provided in a part at the other end of the flow path member 311 in the longitudinal direction.

Each of the coupling pipes 312, 313, 314, and 315 is a pipe body protruding from the flow path member 311. The coupling pipe 312 is a supply pipe provided with a supply port Sa_in for supplying the first ink to the flow path member 311. Similarly, the coupling pipe 313 is a supply pipe provided with a supply port Sb_in for supplying the second ink to the flow path member 311. On the other hand, the coupling pipe 314 is an exhaust pipe provided with an exhaust port Da_out for exhausting the first ink from the flow path member 311. Similarly, the coupling pipe 315 is an exhaust pipe provided with an exhaust port Db_out for exhausting the second ink from the flow path member 311.

The wiring substrate 32 is a mounting component for electrically coupling the head unit 252 to the control unit 21. The wiring substrate 32 is formed of, for example, a flexible wiring substrate, a rigid wiring substrate, or the like. The wiring substrate 32 is disposed on the flow path structure 31.

One surface of the wiring substrate 32 faces the flow path structure 31. A connector 35 is installed on the other surface of the wiring substrate 32. The connector 35 is a coupling component for electrically coupling the head unit 252 and the control unit 21. Further, although not shown, wirings coupled to the plurality of circulation heads Hn are coupled to the wiring substrate 32. The wiring is configured with, for example, a combination of a flexible wiring substrate and a rigid wiring substrate. The wiring may be integrated with the wiring substrate 32.

The holder 33 is a structure that accommodates and supports the plurality of circulation heads Hn. The holder 33 is made of, for example, a resin material or a metal material or the like. The holder 33 is provided with a plurality of recess portions 331, a plurality of ink holes 332, a plurality of wiring holes 333, and a pair of flanges 334. Each of the plurality of recess portions 331 is a space that opens in the Z2 direction and in which the circulation head Hn is disposed. Each of the plurality of ink holes 332 is a flow path through which the ink flows between the circulation head Hn disposed in the recess portion 331 and the flow path structure 31 described above. Each of the plurality of wiring holes 333 is a hole through which a wiring (not shown) that couples the circulation head Hn and the wiring substrate 32 is passed. The pair of flanges 334 is fixing portions for fixing the holder 33 to the support body 251. The pair of flanges 334 illustrated in FIG. 3 are provided with holes 335 for screwing to the support body 251. The above-described screw 256 is passed through the hole 335.

Each circulation head Hn discharges the ink. That is, although not shown in FIG. 3, each circulation head Hn has a plurality of nozzles that discharge the first ink and a plurality of nozzles that discharge the second ink. The configuration of the circulation head Hn will be described later.

The fixing plate 36 is a plate member for fixing the plurality of circulation heads Hn to the holder 33. Specifically, the fixing plate 36 is disposed so as to sandwich the plurality of circulation heads Hn with the holder 33, and is fixed to the holder 33 with an adhesive. The fixing plate 36 is made of, for example, a metal material or the like. The fixing plate 36 is provided with a plurality of opening portions 361 for exposing the nozzles of the plurality of circulation heads Hn. In the example of FIG. 3, the plurality of opening portions 361 are individually provided for each circulation head Hn. The opening portion 361 may be shared by two or more circulation heads Hn.

The reinforcing plate 37 is a plate-shaped member that is disposed between the holder 33 and the fixing plate 36 and reinforces the fixing plate 36. The reinforcing plate 37 is arranged on the fixing plate 36 in an overlapping manner and fixed to the fixing plate 36 with an adhesive. The reinforcing plate 37 is provided with a plurality of opening portions 371 in which the plurality of circulation heads Hn are disposed. The reinforcing plate 37 is made of, for example, a metal material or the like. From the viewpoint of reinforcing the fixing plate 36, the thickness of the reinforcing plate 37 is desirably larger than the thickness of the fixing plate 36.

The cover 38 is a box-shaped member that accommodates the flow path member 311 of the flow path structure 31 and the wiring substrate 32. The cover 38 is made of, for example, a resin material or the like. The cover 38 is provided with four through holes 381 and an opening portion 382. The four through holes 381 correspond to the four coupling pipes 312 of the flow path structure 31, and a corresponding coupling pipe 312, 313, 314, or 315 is passed through each through hole 381. The connector 35 is passed through the opening portion 382 from the inside of the cover 38 to the outside.

Figure 4:
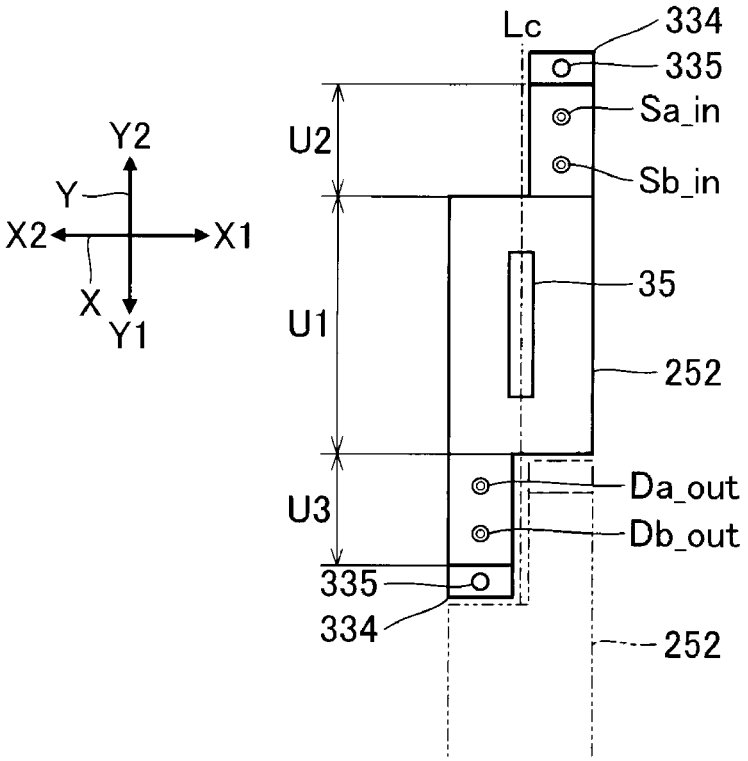
FIG. 4 is a plan view of the head unit as viewed from a Z1 direction.

FIG. 4 is a plan view of the head unit 252 as viewed from the Z1 direction. As illustrated in FIG. 4, each head unit 252 is formed with an outer shape that includes a first part U1, a second part U2, and a third part U3 when viewed from the Z1 direction. The first part U1 is positioned between the second part U2 and the third part U3. Specifically, the second part U2 is positioned in the Y2 direction with respect to the first part U1, and the third part U3 is positioned in the Y1 direction with respect to the first part U1. In the present embodiment, each of the flow path structure 31 and the holder 33 is formed with an outer shape corresponding to the head unit 252 when viewed from the Z1 direction. The wiring substrate 32 is formed with an outer shape corresponding to the first part U1 when viewed from the Z1 direction.

In FIG. 4, a center line Lc, which is a line segment passing through a center of the first part U1 along the Y axis, is illustrated. The second part U2 is positioned in the X1 direction with respect to the center line Lc, and the third part U3 is positioned in the X2 direction with respect to the center line Lc. That is, the second part U2 and the third part U3 are positioned on opposite sides of the X axis with the center line Lc interposed therebetween. As illustrated in FIG. 4, the plurality of head units 252 are arranged along the Y axis so that the third part U3 of each head unit 252 and the second part U2 of the other head unit 252 partially overlap each other along the Y axis.

Figure 5:
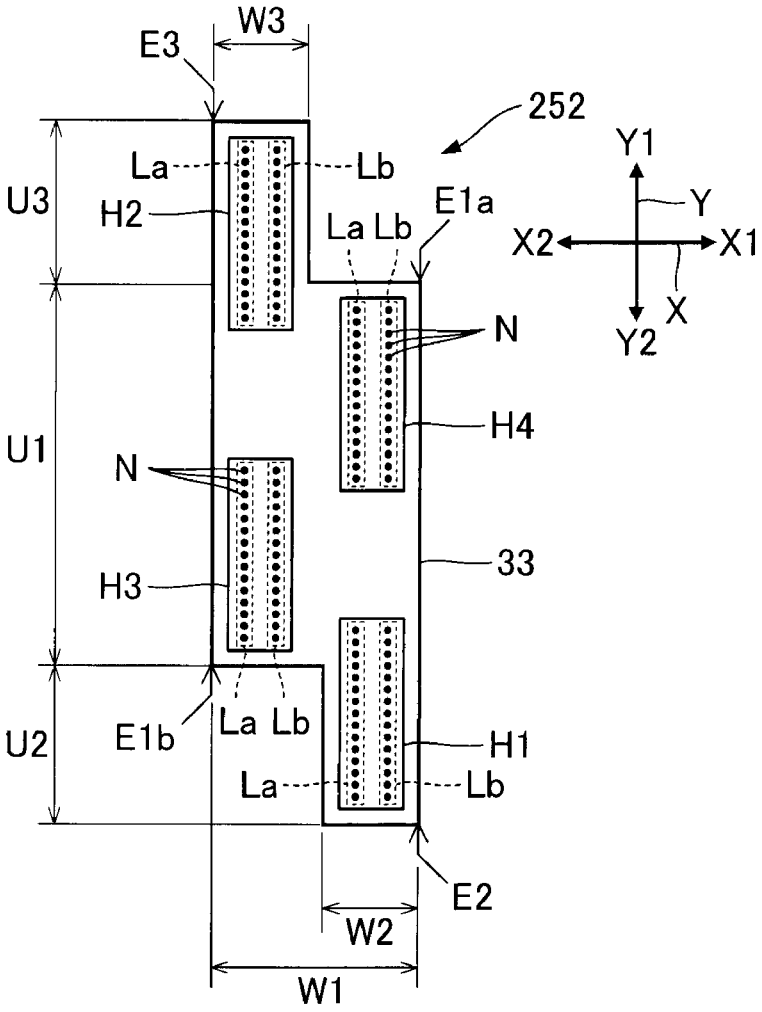
FIG. 5 is a plan view of the head unit as viewed from a Z2 direction.

FIG. 5 is a plan view of the head unit 252 as viewed from the Z2 direction. In FIG. 5, the illustration of the pair of flanges 334 is omitted for convenience of description. As illustrated in FIG. 5, the width W2 of the second part U2 along the X axis is shorter than the width W1 of the first part U1 along the X axis. Similarly, the width W3 of the third part U3 along the X axis is shorter than the width W1 of the first part U1 along the X axis. The width W2 and the width W3 illustrated in FIG. 4 are equal to each other. The width W2 and the width W3 may be different from each other. However, when the width W2 and the width W3 are equal to each other, it is possible to increase the symmetry of the shape of the head unit 252, and as a result, there is an advantage that the plurality of head units 252 can be easily arranged densely. The widths W1, W2, and W3 of the first part U1, the second part U2, and the third part U3 are the widths between one end and the other end along the X axis of each part.

An end surface Ela of the first part U1 in the X1 direction is a plane continuous with an end surface E2 of the second part U2 in the X1 direction. On the other hand, an end surface E1*b* of the first part U1 in the X2 direction is a plane continuous with an end surface E3 of the third part U3 in the X2 direction. A recess portion or a projection portion may be appropriately provided on these end surfaces. Further, a step may be provided between the end surface Ela and the end surface E2, and a step may be provided between the end surface E1*b* and the end surface E3.

As illustrated in FIG. 5, the holder 33 of the head unit 252 holds four circulation heads Hn (n=1 to 4). Each circulation head Hn (n=1 to 4) discharges the ink from a plurality of nozzles N. As illustrated in FIG. 5, the plurality of nozzles N are divided into a nozzle row La and a nozzle row Lb. Each of the nozzle row La and the nozzle row Lb is a set of the plurality of nozzles N arranged along the Y axis. The nozzle row La and the nozzle row Lb are provided side by side with an interval in between in the direction of the X axis. In the following description, the subscript a is added to the reference numeral of the element related to the nozzle row La, and the subscript b is added to the reference numeral of the element related to the nozzle row Lb.

1-3. Circulation Head Hn

Figure 6:
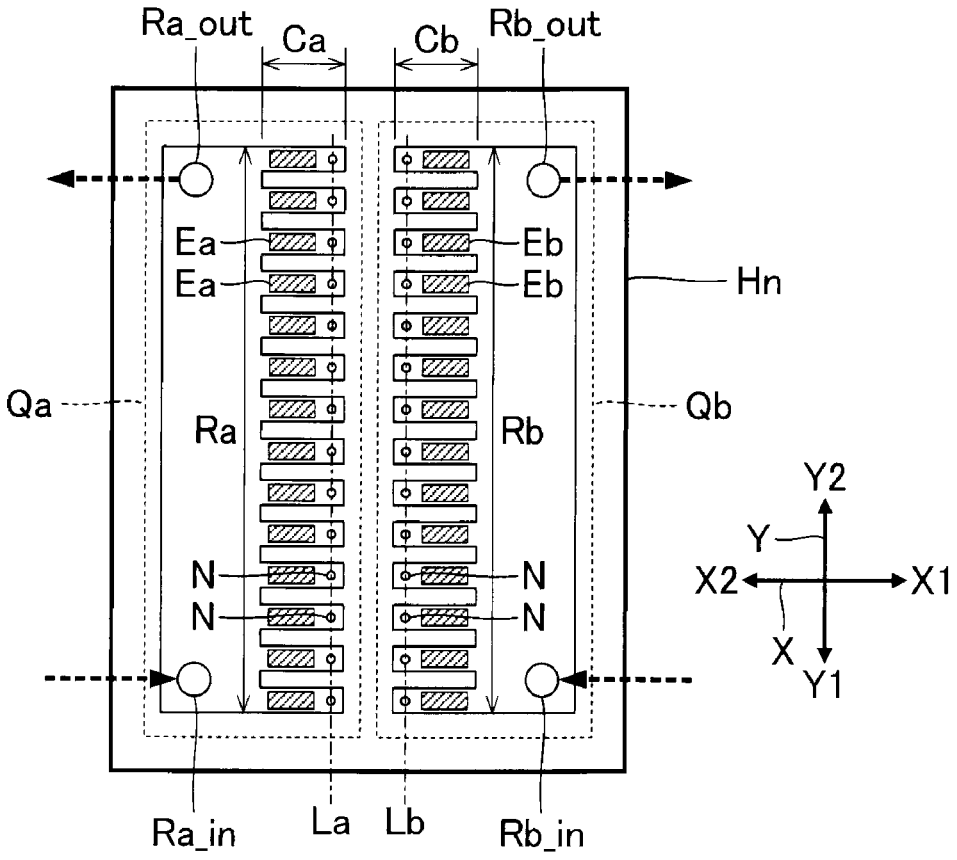
FIG. 6 is a plan view of a circulation head.

FIG. 6 is a plan view of the circulation head Hn. FIG. 6 schematically shows the internal structure of the circulation head Hn viewed from the Z1 direction. As illustrated in FIG. 6, each circulation head Hn includes a liquid discharging portion Qa and a liquid discharging portion Qb. The liquid discharging portion Qa of each circulation head Hn discharges the first ink supplied from the sub tank 13*a* from each nozzle N of the nozzle row La. The liquid discharging portion Qb of each circulation head Hn discharges the second ink supplied from the sub tank 13*b* from each nozzle N of the nozzle row Lb.

The liquid discharging portion Qa includes a liquid storage chamber Ra, a plurality of pressure chambers Ca, and a plurality of driving elements Ea. The liquid storage chamber Ra is a common liquid chamber that is continuous over the plurality of nozzles N of the nozzle row La. The pressure chamber Ca and the driving element Ea are formed for each nozzle N of the nozzle row La. The pressure chamber Ca is a space for communicating with the nozzle N. Each of the plurality of pressure chambers Ca is filled with the first ink supplied from the liquid storage chamber Ra. The driving element Ea changes the pressure of the first ink inside the pressure chamber Ca. For example, a piezoelectric element that changes the volume of the pressure chamber Ca by deforming the wall surface of the pressure chamber Ca or a heat generating element that generates bubbles inside the pressure chamber Ca by heating the first ink inside the pressure chamber Ca is desirably utilized as the driving element Ea. The driving element Ea changes the pressure of the first ink in the pressure chamber Ca, and thus the first ink inside the pressure chamber Ca is discharged from the nozzle N.

The liquid discharging portion Qb includes a liquid storage chamber Rb, a plurality of pressure chambers Cb, and a plurality of driving elements Eb, like the liquid discharging portion Qa. The liquid storage chamber Rb is a common liquid chamber that is continuous over the plurality of nozzles N of the nozzle row Lb. The pressure chamber Cb and the driving element Eb are formed for each nozzle N of the nozzle row Lb. Each of the plurality of pressure chambers Cb is filled with the second ink supplied from the liquid storage chamber Rb. The driving element Eb is, for example, the above-described piezoelectric element or heat generating element. The driving element Eb changes the pressure of the second ink inside the pressure chamber Cb, and thus the second ink inside the pressure chamber Cb is discharged from the nozzle N.

As illustrated in FIG. 6, each circulation head Hn is provided with a supply port Ra_in, an exhaust port Ra_out, a supply port Rb_in, and an exhaust port Rb_out. The supply port Ra_in and the exhaust port Ra_out communicate with the liquid storage chamber Ra. The supply port Rb_in and the exhaust port Rb_out communicate with the liquid storage chamber Rb.

The first ink, among the first ink stored in the liquid storage chamber Ra of each circulation head Hn described above, that is not discharged from each nozzle N of the nozzle row La circulates in the path of the exhaust port Ra_out→the exhaust flow path for the first ink of the flow path structure 31→the sub tank 13*a* provided outside the head unit 252→the supply flow path for the first ink of the flow path structure 31→the supply port Ra_in→the liquid storage chamber Ra. Similarly, the second ink, among the second ink stored in the liquid storage chamber Rb of each circulation head Hn, that is not discharged from each nozzle N of the nozzle row Lb circulates in the path of the exhaust port Rb_out→the exhaust flow path for the second ink of the flow path structure 31→the sub tank 13*b* provided outside the head unit 252→the supply flow path for the second ink of the flow path structure 31→the supply port Rb_in→the liquid storage chamber Rb.

1-4. Flow Path Structure 31

Figure 7:
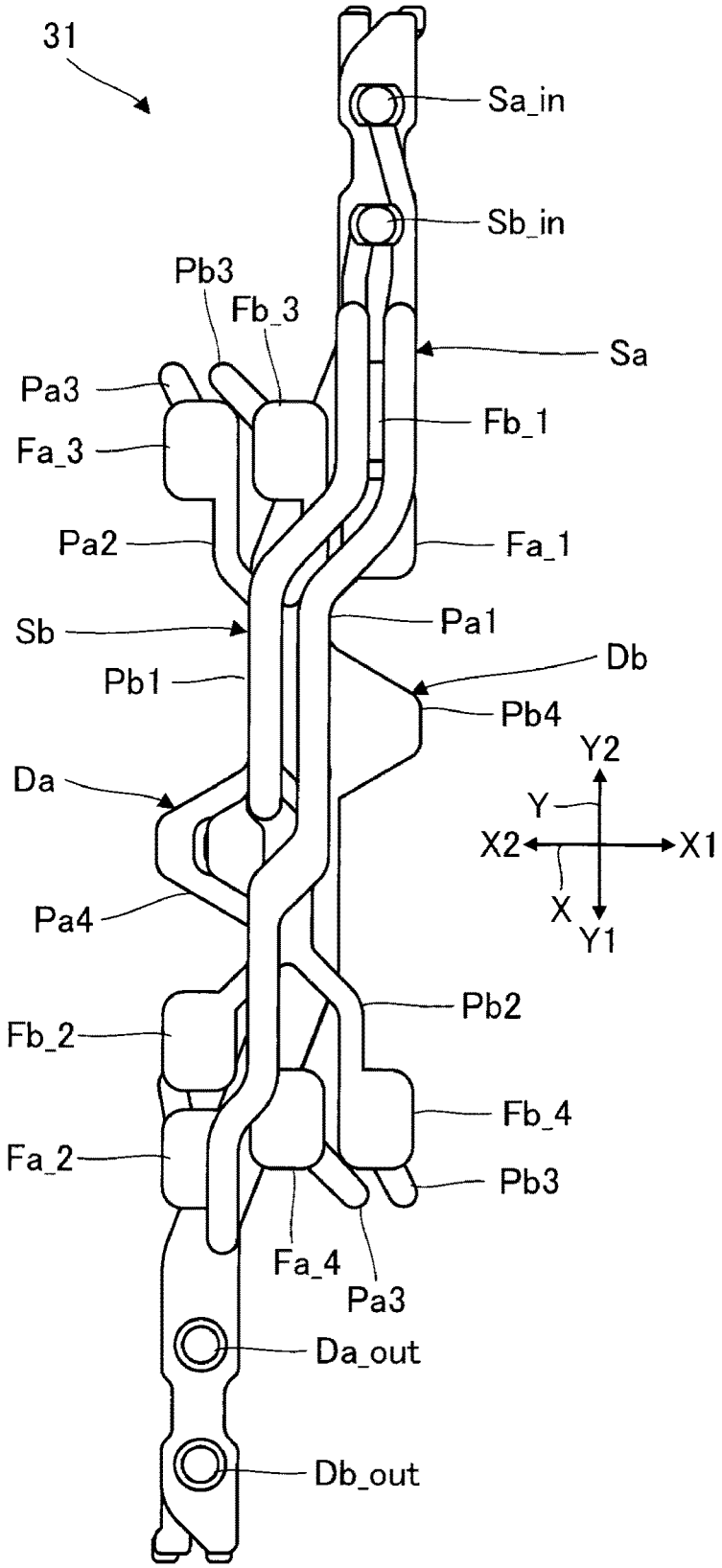
FIG. 7 is a plan view illustrating a flow path provided in a flow path member.
Figure 8:
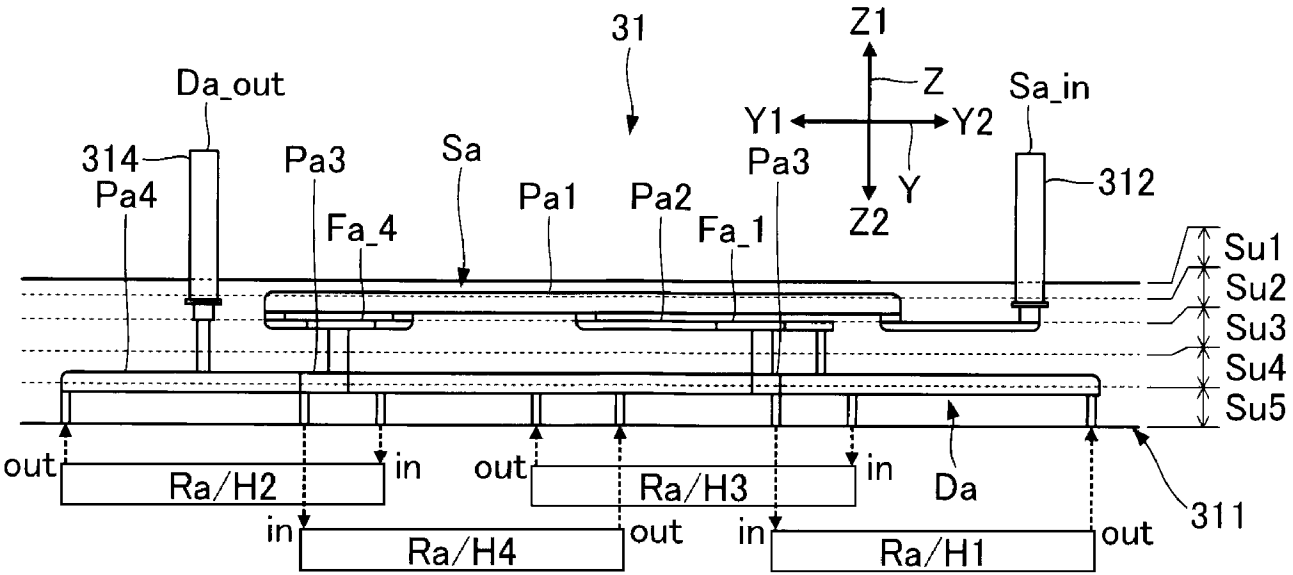
FIG. 8 is a side view of a supply flow path and an exhaust flow path for a first ink among flow paths provided in the flow path member.
Figure 9:
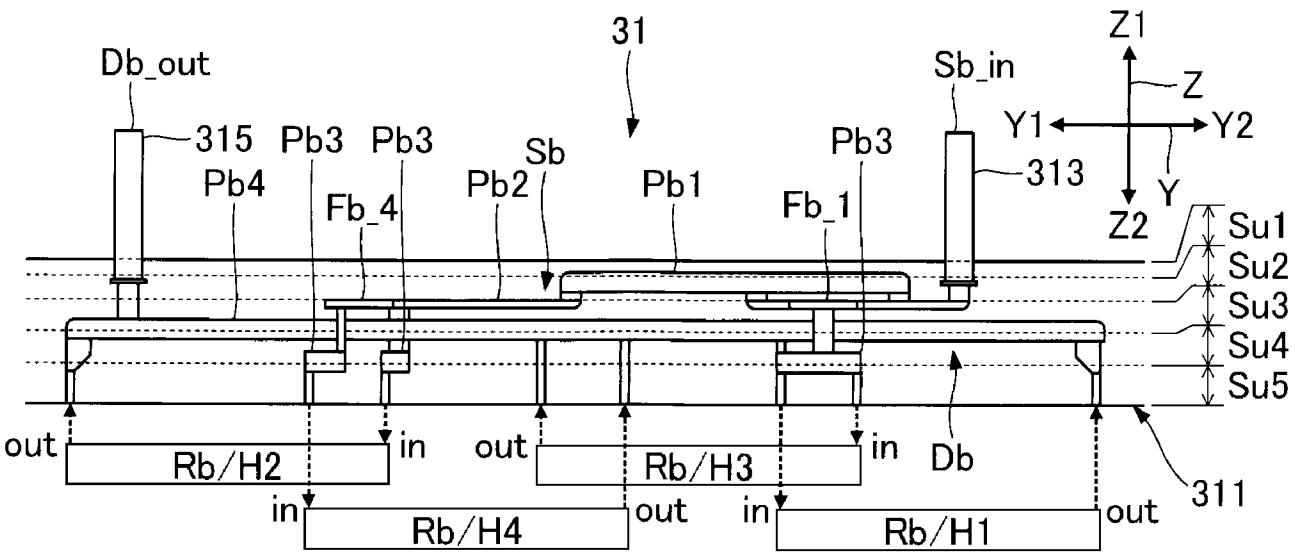
FIG. 9 is a side view of a supply flow path and an exhaust flow path for a second ink among flow paths provided in the flow path member.

FIG. 7 is a plan view illustrating a flow path provided in the flow path structure 31. FIG. 8 is a side view of a supply flow path Sa and an exhaust flow path Da for the first ink among flow paths provided in the flow path structure 31. FIG. 9 is a side view of a supply flow path Sb and an exhaust flow path Db for the second ink among flow paths provided in the flow path structure 31. In FIGS. 8 and 9, the liquid storage chamber Ra of each circulation head Hn is represented by a symbol "Ra/Hn", and the liquid storage chamber Rb of each circulation head Hn is represented by a symbol "Rb/Hn". The configuration of the flow path in the flow path structure 31 is not limited to the following configuration. Further, as will be described later, in the flow path member 311 according to the present embodiment, the thickness of the first layer Su1, the second layer Su2, the third layer Su3, the fourth layer Su4, and the fifth layer Su5 along the Z axis are actually different from each other according to a predetermined condition. However in FIGS. 8 and 9, for the sake of convenience, these thicknesses are described without considering the predetermined condition. Further, in FIGS. 8 and 9, for the sake of convenience, the depths (height in the Z axis) of the horizontally (XY direction) extending parts of the supply flow path Sa, the supply flow path Sb, the exhaust flow path Da, and the exhaust flow path Db are shown to be partially different from each other. However, the depths of the horizontally extending parts of the supply flow path Sa, the supply flow path Sb, the exhaust flow path Da, and the exhaust flow path Db are substantially equal to each other.

Inside the flow path structure 31, as illustrated in FIG. 7, the supply flow path Sa, the exhaust flow path Da, the supply flow path Sb, and the exhaust flow path Db are provided. The supply flow path Sa is a flow path from the supply port Sa_in to the liquid storage chamber Ra of each circulation head Hn. The exhaust flow path Da is a flow path from the liquid storage chamber Ra of each circulation head Hn to the exhaust port Da_out. The supply flow path Sb is a flow path from the supply port Sb_in to the liquid storage chamber Rb of each circulation head Hn. The exhaust flow path Db is a flow path from the liquid storage chamber Rb of each circulation head Hn to the exhaust port Da_out.

As illustrated in FIGS. 7 and 8, the supply flow path Sa is a flow path that includes a supply portion Pa1, a connection portion Pa2, four filter chambers Fa_1 to Fa_4, and four connection portions Pa3. The supply portion Pa1 is an example of the first flow path. The connection portion Pa2 is an example of the second flow path. As illustrated in FIG. 8, the supply portion Pa1 is formed between the first layer Su1 and the second layer Su2. The supply portion Pa1 has a shape extending along the Y axis. The supply port Sa_in communicates with the end of the supply portion Pa1 in the Y2 direction.

The connection portion Pa2 and the four filter chambers Fa_1 to Fa_4 are formed between the second layer Su2 and the third layer Su3. Each of the filter chambers Fa_1 to Fa_4 is provided with a filter that collects foreign matter or bubbles mixed in the first ink. The connection portion Pa2 communicates with the supply portion Pa1 through a through hole formed at the second layer Su2. The connection portion Pa2 extends in the Y2 direction from a coupling position with the supply portion Pa1 and branches into two systems to communicate with the filter chamber Fa_1 and the filter chamber Fa_3.

The filter chamber Fa_2 communicates with the supply portion Pa1 through a through hole formed at the second layer Su2. The filter chamber Fa_4 communicates with the supply portion Pa1 through a through hole formed at the second layer Su2. Each of the filter chambers Fa_1 to Fa_4 communicates with the supply port Ra_in of each circulation head Hn through a through hole that penetrates the third layer Su3, the fourth layer Su4, and the fifth layer Su5. A connection portion Pa3 formed between the fourth layer Su4 and the fifth layer Su5 is provided in the middle of the through hole.

As illustrated in FIG. 7 and FIG. 9, the supply flow path Sb is a flow path that includes the supply portion Pb1, the connection portion Pb2, the four filter chambers Fb_1 to Fb_4, and the four connection portions Pb3. The supply portion Pb1 is an example of the first flow path. The connection portion Pb2 is an example of the second flow path. The supply portion Pb1 is formed between the first layer Su1 and the second layer Su2. The supply portion Pb1 has a shape extending along the Y axis. The supply port Sb_in communicates with the end of the supply portion Pb1 in the Y2 direction. The supply portion Pa1 and the supply portion Pb1 are provided side by side between the first layer Su1 and the second layer Su2.

The connection portion Pb2 and the four filter chambers Fb_1 to Fb_4 are formed between the second layer Su2 and the third layer Su3. Each of the filter chambers Fb_1 to Fb_4 is provided with a filter that collects foreign matter or bubbles mixed in the second ink. The connection portion Pb2 communicates with the supply portion Pb1 through a through hole formed at the second layer Su2. The connection portion Pb2 extends in the Y1 direction from a coupling position with the supply portion Pb1 and branches into two systems to communicate with the filter chamber Fb_2 and the filter chamber Fb_4. The connection portion Pb2 extends from the coupling position with the supply portion Pb1 in the direction opposite to the connection portion Pa2.

The filter chamber Fb_1 communicates with the supply portion Pb1 through a through hole formed at the second layer Su2. The filter chamber Fb_3 communicates with the supply portion Pb1 through a through hole formed at the second layer Su2. Each of the filter chambers Fb_1 to Fb_4 communicates with the supply port Rb_in of each circulation head Hn through a through hole that penetrates the third layer Su3, the fourth layer Su4, and the fifth layer Su5. A connection portion Pb3 formed between the fourth layer Su4 and the fifth layer Su5 is provided in the middle of the through hole.

As illustrated in FIGS. 7 and 8, the exhaust flow path Da is a flow path that includes an exhaust portion Pa4. The exhaust portion Pa4 is an example of a fourth flow path. The exhaust portion Pa4 is formed between the fourth layer Su4 and the fifth layer Su5. The exhaust portion Pa4 has a shape extending along the Y axis over a wider range than the supply portion Pa1. The vicinity of the end portion of the exhaust portion Pa4 in the Y1 direction communicates with the exhaust port Da_out. The exhaust port Ra_out of each circulation head Hn communicates with the exhaust portion Pa4 through a through hole that penetrates the fifth layer Su5.

As illustrated in FIGS. 7 and 9, the exhaust flow path Db is a flow path that includes the exhaust portion Pb4. The exhaust portion Pb4 is an example of a third flow path. The exhaust portion Pb4 is formed between the third layer Su3 and the fourth layer Su4. The exhaust portion Pb4 has a shape extending along the Y axis over a wider range than the supply portion Pb1. The vicinity of the end portion of the exhaust portion Pb4 in the Y1 direction communicates with the exhaust port Db_out. The exhaust port Rb_out of each circulation head Hn communicates with the exhaust portion Pb4 through a through hole that penetrates the fourth layer Su4 and the fifth layer Su5.

1-5. Dimensions of Each Part of the Flow Path Member 311

Figure 10:
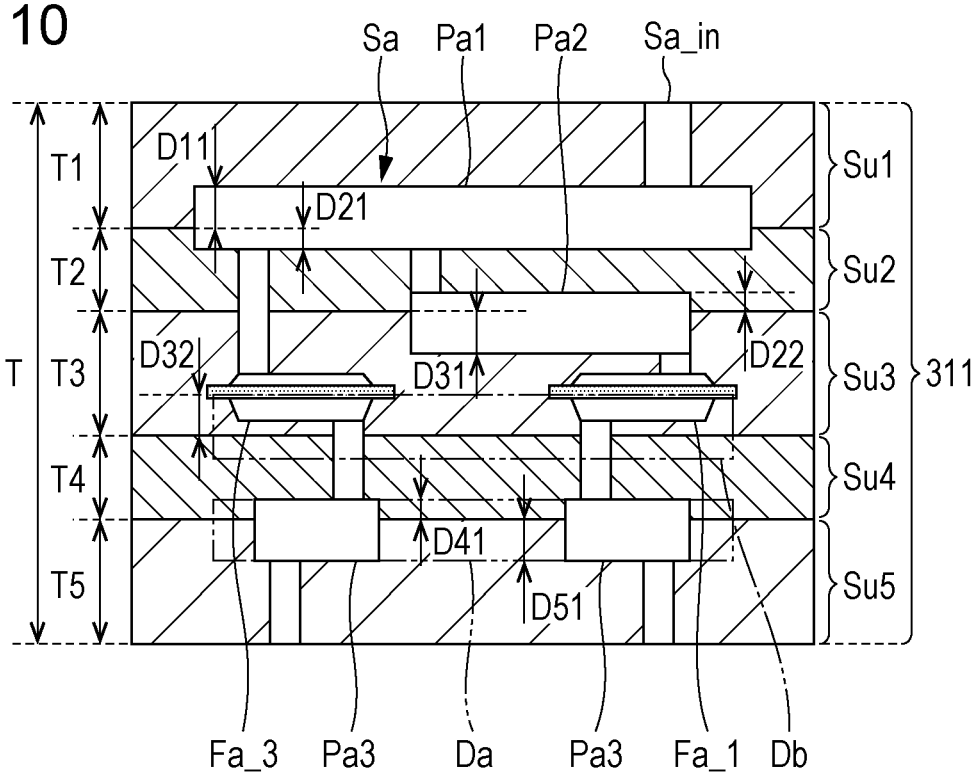
FIG. 10 is a cross-sectional view schematically showing the flow path member according to the first embodiment.
Figure 11:
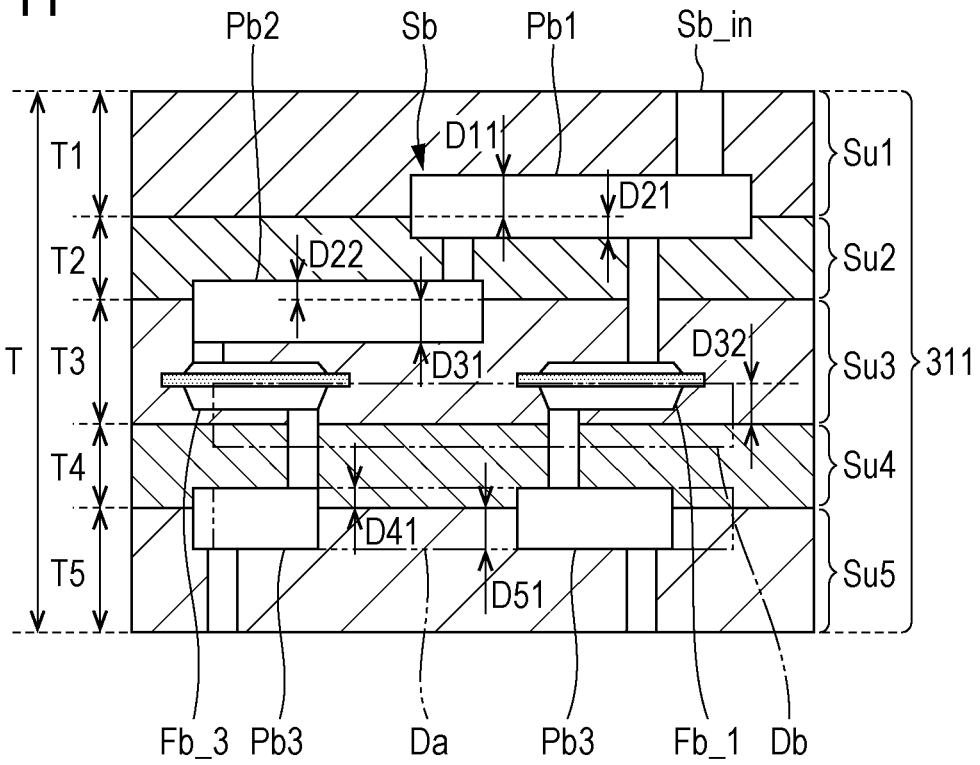
FIG. 11 is a cross-sectional view schematically showing the flow path member according to the first embodiment.

FIGS. 10 and 11 are cross-sectional views schematically showing the flow path member 311 according to the first embodiment. In FIG. 10, for convenience of description, the supply flow path Sa is shown as a representative among the flow paths provided in the flow path member 311. In FIG. 11, for convenience of description, the supply flow path Sb is shown as a representative among the flow paths provided in the flow path member 311. In each of FIG. 10 and FIG. 11, the exhaust flow path Da extending over the fourth layer Su4 and the fifth layer Su5, and the exhaust flow path Db extending over the third layer Su3 and the fourth layer Su4 are indicated by broken lines.

In the flow path member 311, each of the thickness T2 of the second layer Su2 and the thickness T4 of the fourth layer Su4 is thinner than the thickness T3 of the third layer Su3. FIG. 10 illustrates a configuration in which the thickness T1 of the first layer Su1, the thickness T2 of the second layer Su2, the thickness T4 of the fourth layer Su4, and the thickness T5 of the fifth layer Su5 are equal to each other. The thicknesses T1, T2, T4, and T5 may be different from each other. Details of the present embodiment shown in FIGS. 10 and 11 will be described after describing conditions A to D below.

By making each of the thickness T2 of the second layer Su2 and the thickness T4 of the fourth layer Su4 thinner than the thickness of the other layers, the thickness T of the flow path member 311 can be reduced without causing other adverse effects. Hereinafter, this point will be described in detail.

In the present embodiment, the thicknesses T1 to T5 of the respective layers are set according to the following conditions A to D.

Condition A: Do not set T1=T2=T3=T4=T5.

Condition B: Set T3 larger than T1, T2, T4, and T5.

Condition C: Do not set both of two layers adjacent to each other smaller than the other layers.

Condition D: Do not set T1 to be small and T2 to be large instead.

The conditions A, B, C, and D will be described in detail below.

Figure 12:
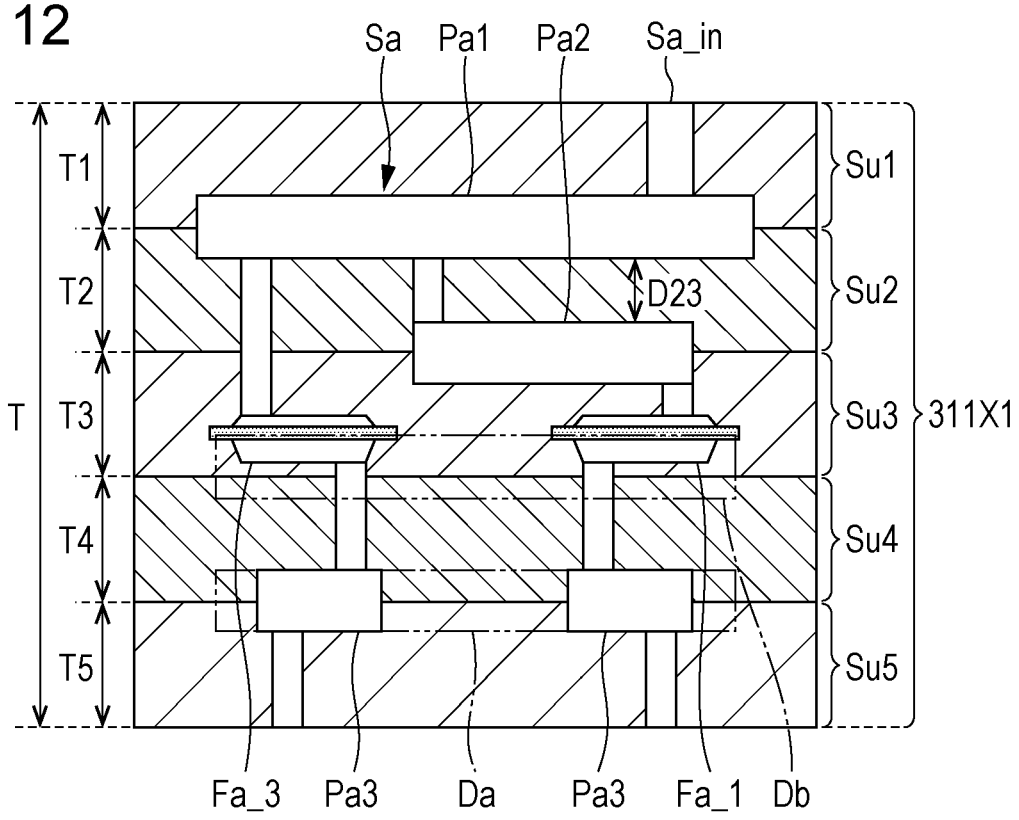
FIG. 12 is a cross-sectional view schematically showing a flow path member according to Reference Example 1.

The condition A will be described. FIG. 12 is a cross-sectional view schematically showing a flow path member 311X1 according to Reference Example 1. In the flow path member 311X1, the thickness T1 of the first layer Su1, the thickness T2 of the second layer Su2, the thickness T3 of the third layer Su3, the thickness T4 of the fourth layer Su4, and the thickness T5 of the fifth layer Su5 are equal to each other. In this case, the distance D23 between the supply portion Pa1 and the connection portion Pa2 becomes larger than necessary. Therefore, making the thicknesses T1, T2, T3, T4, and T5 equal to each other is not desirable for reducing the thickness T of the flow path member 311X1. Accordingly, in order to reduce the thickness T of the flow path member 311, it is necessary to satisfy the "condition A" that "Do not set thicknesses T1, T2, T3, T4, and T5 equal to each other".

The condition B will be described. As described above, the third layer Su3 is provided with not only the connection portion Pa2 but also the filter chambers Fa_1 to Fa_4 and Fb_1 to Fb_4. Therefore, the third layer Su3 is required to be thicker than the other layers. Accordingly, in order to reduce the thickness T of the flow path member 311 and secure the function required for the flow path member 311, it is necessary to satisfy the "condition B" that "The thickness T3 is thicker than each of the thicknesses T1, T2, T4, and T5.".

Figure 13:
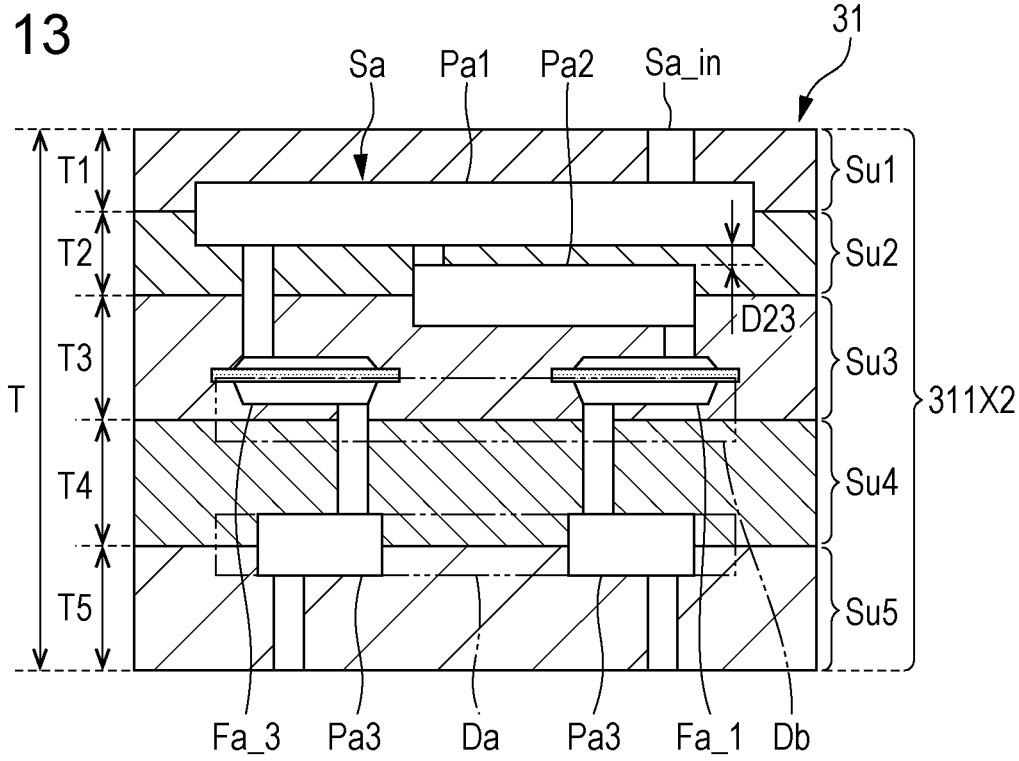
FIG. 13 is a cross-sectional view schematically showing a flow path member according to Reference Example 2.

The condition C will be described. FIG. 13 is a cross-sectional view schematically showing a flow path member 311X2 according to Reference Example 2. In the flow path member 311X2, each of the thickness T1 of the first layer Su1 and the thickness T2 of the second layer Su2 is thinner than each of the thickness T3 of the third layer Su3, the thickness T4 of the fourth layer Su4, and the thickness T5 of the fifth layer Su5. In this case, the distance D23 between the supply portion Pa1 and the connection portion Pa2 becomes too small, and as a result, there is a problem that the rigidity required for the second layer Su2 cannot be secured. This problem similarly occurs in the other two layers adjacent to each other. Accordingly, in order to reduce the thickness T of the flow path member 311 and secure the function required for the flow path member 311, it is necessary to satisfy the "condition C" that "Do not make both of two layers adjacent to each other, among the layers Su1 to Su5, thinner than the remaining layers.".

Figure 14:
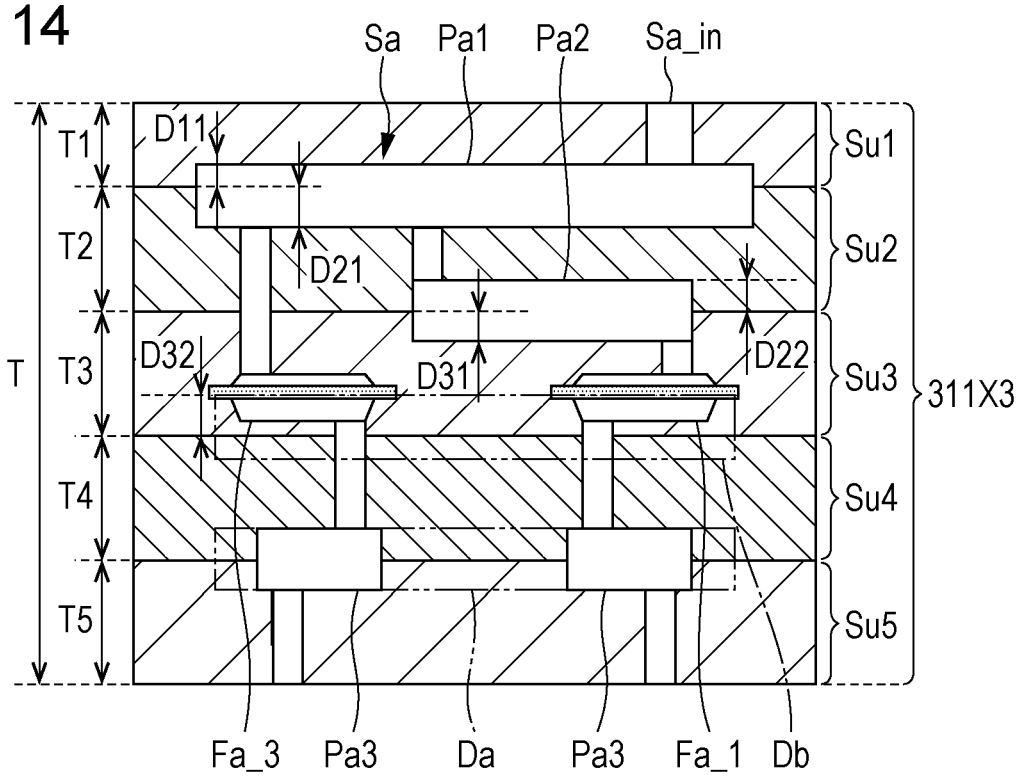
FIG. 14 is a cross-sectional view schematically showing a flow path member according to Reference Example 3.

The condition D will be described. FIG. 14 is a cross-sectional view schematically showing a flow path member 311X3 according to Reference Example 3. In the flow path member 311X3, the thickness T1 of the first layer Su1 positioned at the end in the laminating direction (Z axis) is thinner than each of the thickness T2 of the second layer Su2, the thickness T3 of the third layer Su3, the thickness T4 of the fourth layer Su4, and the thickness T5 of the fifth layer Su5. In this case, when the supply portion Pa1 is provided at the center of the first layer Su1 and the second layer Su2, in other words, when the depth D11 of the supply portion Pa1 in the first layer Su1 and the depth D21 of the supply portion Pa1 in the second layer Su2 are made equal, the depth occupied by the supply portion Pa1 is relatively large in the first layer Su1. In this way, when a cavity portion such as a flow path is provided only on one surface side in a certain single layer, the deeper the depth is, the stronger force is generated in the direction in which a projection bending occurs on the surface side.

Since the first layer Su1 is positioned at the end in the laminating direction, the layer that suppresses the bending of the first layer Su1 is not in contact with the other side (Z1 side) in the laminating direction. Therefore, the first layer Su1 has a smaller suppressing force when a force that causes bending occurs than the second layer Su2, the third layer Su3, or the like, and the possibility that the first layer Su1 actually bends increases.

Therefore, when the first layer Su1 is thinned and the supply portion Pa1 is provided at the center of the first layer Su1 and the second layer Su2 (D11=D21), there is a concern that the bending may be likely to occur. Accordingly, when reducing the thickness T1 of the first layer, as shown in FIG. 14, it is necessary that the supply portion Pa1 is disposed closer to the second layer Su2 than the first layer Su1 so that the depth D11 of the supply portion Pa1 in the first layer Su1 is smaller than the depth D21 of the supply portion Pa1 in the second layer Su2.

On the other hand, in FIG. 14, the connection portion Pa2 is provided at the center of the second layer Su2 and the third layer Su3. In other words, the depth D22 and the depth D31 are set to be the same. Thereafter, since the supply portion Pa1 and the connection portion Pa2 have substantially the same depth, the depth D21 occupied by the supply portion Pa1 in the second layer Su2 is smaller than the depth D22 occupied by the connection portion Pa2.

There is a possibility that a projection bending may occur in the deeper part of the cavity portion when a cavity portion such as a flow path is provided in a certain single layer and when the depth of the cavity portion provided on one surface side differs from the depth of the cavity portion provided on the other surface side. Therefore, in Reference Example 3, an upward (Z1 direction) projection is generated in the second layer Su2, and as a result, the second layer Su2 becomes easily bent.

According to Reference Example 3, when the thickness T1 of the first layer Su1 is thinned, it can be seen that the following two cases (1) and (2) are not desirable. (1) the supply portion Pa1 is provided at the center of the first layer Su1 and the second layer Su2, and (2) the supply portion Pa1 is provided at the center of the first layer Su1 and the second layer Su2, the supply portion Pa1 is provided closer to the second layer Su2 than the first layer Su1, and the connection portion Pa2 is provided at the center of the second layer Su2 and the third layer Su3. Next, it will be explained that the following case (3) is not also desirable. (3) the supply portion Pa1 is provided at the center of the first layer Su1 and the second layer Su2, the supply portion Pa1 is provided closer to the second layer Su2 than the first layer Su1, and the connection portion Pa2 is provided closer to the second layer Su2 side than the third layer Su3.

Figure 15:
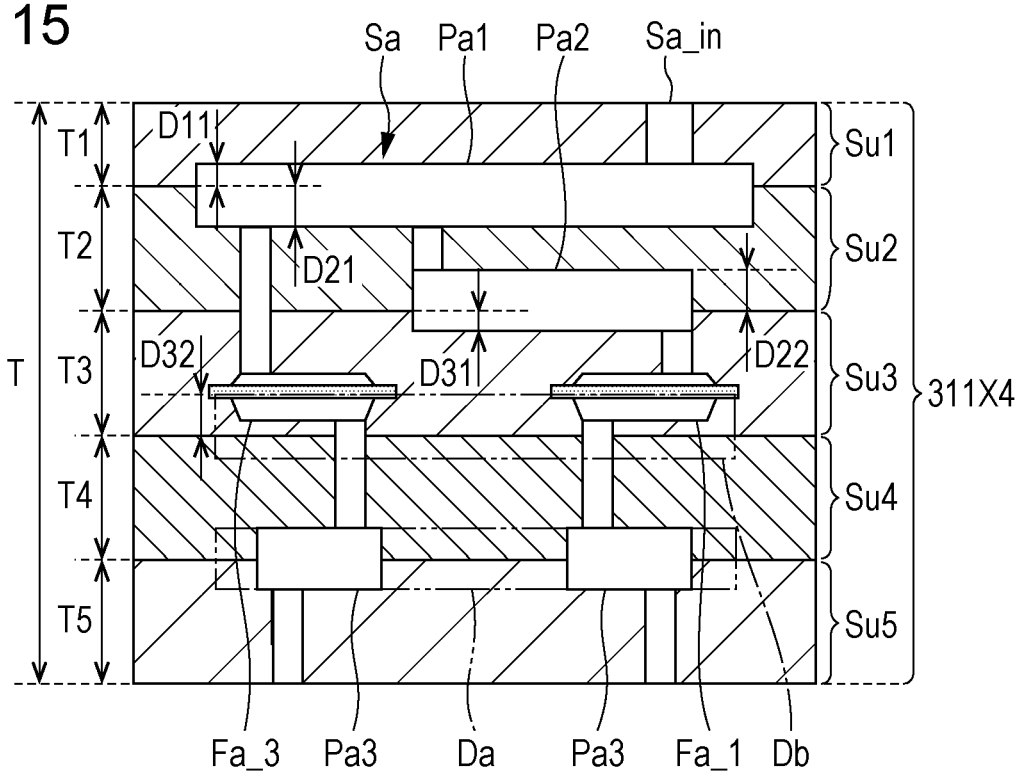
FIG. 15 is a cross-sectional view schematically showing a flow path member according to Reference Example 4.

FIG. 15 is a cross-sectional view schematically showing a flow path member 311X4 according to Reference Example 4. In the flow path member 311X4, the size relationship among the thicknesses T1, T2, T3, T4, and T5 is the same as that of the flow path member 311X3 described above but the depth D21 of the supply portion Pa1 in the second layer Su2 and the depth D22 of the connection portion Pa2 in the second layer Su2 are equal to each other. That is, as compared with Reference Example 3, the connection portion Pa2 is closer to the second layer Su2 side than the third layer Su3. In other words, the depth D22 is made larger than the depth D31. In this way, unlike Reference Example 3, the depth D21 occupied by the supply portion Pa1 and the depth occupied by the connection portion Pa2 in the second layer Su2 can be the same. Therefore, the second layer Su2 is unlikely to bend.

However, in Reference Example 4, since the connection portion Pa2 is disposed closer to the second layer Su2 side, the depth D31 occupied by the connection portion Pa2 in the third layer Su3 becomes smaller. Therefore, the depth D31 occupied by the connection portion Pa2 in the third layer Su3 is smaller than the depth D32 occupied by the exhaust flow path Db. As a result, similarly to the second layer Su2 shown in FIG. 14 described above, the third layer Su3 is easily bent. As described above, according to Reference Example 4, it is understood that the above case (3) is also not desirable. In addition to the above case (3), even when the exhaust flow path Db is provided closer to the fourth layer Su4 side than the third layer Su3, bending occurs in the fourth layer Su4 for the same reason as described in case (3) above.

As described above with reference to Reference Examples 3 and 4, it is not desirable to increase the thickness T2 of the second layer Su2 instead of reducing the thickness T1 of the first layer Su1. Similarly, it is not desirable to increase the thickness T4 of the fourth layer Su4 instead of reducing the thickness T5 of the fifth layer Su5. Accordingly, in order to reduce the thickness T of the flow path member 311 and secure the function required for the flow path member 311, it is necessary to satisfy the "condition D" that "Do not increase the thickness T2 of the second layer Su2 instead of reducing the thickness T1 of the first layer Su1, and do not increase the thickness T4 of the fourth layer Su4 instead of reducing the thickness T5 of the fifth layer Su5."

From the above, in order to reduce the thickness T of the flow path member 311 and to secure the function required for the flow path member 311, it is necessary to satisfy the above-mentioned conditions A, B, C, and D. First, it is necessary to make any one of the first layer Su1 to the fifth layer Su5 thinner than the other layers according to the condition A, but the third layer Su3 cannot be made thinner than the other layers according to the condition B. Therefore, any one of the first layer Su1, the second layer Su2, the fourth layer Su4, and the fifth layer Su5 is made thinner than the third layer Su3. However, according to the condition C, it is not possible to make both the first layer Su1 and the second layer Su2 adjacent to each other thinner, so only one of the first layer Su1 and the second layer Su2 is made thinner. At this time, according to the condition D, only the second layer Su2 is made thinner. Similarly for the fourth layer Su4 and the fifth layer Su5, only the fourth layer Su4 is made thinner.

Therefore, in the present embodiment shown in FIGS. 10 and 11, the thickness T2 of the second layer Su2 and the thickness T4 of the fourth layer Su4 are made thinner than the thickness of the other layers. That is, it is set as T2, T4<T1, T3, T5. Thereby, the thickness T of the flow path member 311 can be reduced without causing other adverse effects as much as possible.

In the present embodiment, as shown in FIGS. 10 and 11, the supply portion Pa1 is provided closer to the first layer Su1 side than the second layer Su2, and the connection portion Pa2 is disposed closer to the third layer Su3 than the second layer Su2. As described above, the depth D21 occupied by the supply portion Pa1 and the depth D22 occupied by the connection portion Pa2 in the second layer Su2 can be made substantially the same, so that the second layer Su2 is less likely to bend. The same applies to the third layer Su3 and the fourth layer Su4.

Further, in the present embodiment, as shown in FIGS. 10 and 11, the first layer Su1 and the fifth layer Su5 are not so thin, and are thicker than the second layer Su2 and the fourth layer Su4. Therefore, it is possible to reduce the possibility of occurrence of bending that tends to occur because it is positioned at the end in the laminating direction.

The thicknesses T1, T2, T3, T4, and T5 only need to satisfy the above-mentioned conditions A, B, C, and D, and the thicknesses T1, T2, T4, and T5 other than the thickness T3 may be equal to or different from each other. However, compared with the case where the thicknesses T1, T2, T4, and T5 are different from each other, the case where the thicknesses T1, T2, T4, and T5 are equal to each other has an advantage that the flow path member 311 can be easily manufactured. Further, the specific thicknesses T1, T2, T3, T4, and T5 are appropriately designed according to the shape of the flow path or the like formed in the flow path member 311.

It is desirable that the ratio of the depth D21 to the depth D22 is substantially one. Specifically, it is desirably 0.8 or more and 1.2 or less, and more desirably 0.9 or more and 1.1 or less. By setting the ratio within the above range, the bending of the second layer Su2 is reduced. In order to set the ratio within the above range, for example, the depth D11 may be larger than the depth D21 and the depth D31 may be larger than the depth D22.

Similarly, it is desirable that the ratio of the depth D31 to the depth D32 is substantially one. Specifically, it is desirably 0.8 or more and 1.2 or less, and more desirably 0.9 or more and 1.1 or less. By setting the ratio within the above range, the bending of the third layer Su3 is reduced. In order to set the ratio within the above range, for example, the depth D31 may be larger than the depth D22.

As can be understood from the above, the head unit 252 includes, as described above, the flow path member 311 through which the ink flows, and the circulation head Hn that is a liquid discharging head which is supplied with the ink from the flow path member 311 and discharges the ink. The flow path member 311 is constituted by laminating the plurality of layers Su1 to Su5. The plurality of layers Su1 to Su5 includes the first layer Su1 which is the outermost layer in the laminating direction among the plurality of layers Su1 to Su5, the second layer Su2 laminated on the first layer Su1, and the third layer Su3, which is laminated on the surface of the second layer Su2 opposite to the first layer Su1. Between the first layer Su1 and the second layer Su2, the supply portions Pa1 and Pb1 which are examples of the first flow path are provided. Between the second layer Su2 and the third layer Su3, the connection portions Pa2 and Pb2 which are examples of the second flow path are provided. Inside the third layer Su3, filter chambers Fa_1 to Fa_4 and Fb_1 to Fb_4 are provided.

Each of the supply portion Pa1 and the connection portion Pa2 is a supply flow path Sa for supplying ink to the circulation head Hn. Similarly, each of the supply portion Pb1 and the connection portion Pb2 is a supply flow path Sb for supplying the ink to the circulation head Hn. The supply flow paths Sa and Sb are provided over a wide range in a direction intersecting the laminating direction of the flow path members 311. Therefore, it can be said that the necessity of satisfying the above-mentioned conditions A, B, C, and D is extremely high.

The second layer Su2 is thinner than each of the first layer Su1 and the third layer Su3. Therefore, the total thickness (T1+T2+T3) of the laminated body constituted by the first layer Su1, the second layer Su2, and the third layer Su3 can be reduced without causing other adverse effects as much as possible.

Further, the plurality of layers Su1 to Su5 includes the fourth layer Su4, which is laminated on a surface of the third layer Su3 opposite to the second layer Su2, and the fifth layer Su5, which is laminated on a surface of the fourth layer Su4 opposite to the third layer Su3 and the outermost layer in the laminating direction among the plurality of layers Su1 to Su5. Between the third layer Su3 and the fourth layer Su4, the exhaust portion Pb4 which is an example of the third flow path is provided. Between the fourth layer Su4 and the fifth layer Su5, the exhaust portion Pa4 which is an example of the fourth flow path is provided.

The exhaust portion Pa4 is an exhaust flow path Da for exhausting the ink from the circulation head Hn. Similarly, the exhaust portion Pb4 is an exhaust flow path Db for exhausting the ink from the circulation head Hn. In this way, the exhaust flow paths Da and Db can be disposed by efficiently utilizing the layers of the flow path member 311. Similarly to the supply flow paths Sa and Sb, the exhaust flow paths Da and Db are provided over a wide range in a direction intersecting the laminating direction of the flow path members 311. Therefore, it can be said that the necessity of satisfying the above-mentioned conditions A, B, C, and D is extremely high.

The second layer Su2 is thinner than the fifth layer Su5. Therefore, the thickness (T1+T2+T3+T4+T5) of the laminated body constituted by the first layer Su1, the second layer Su2, the third layer Su3, the fourth layer Su4, and the fifth layer Su5 can be reduced without causing other adverse effects as much as possible. That is, the thickness T of the flow path member 311 can be reduced.

Moreover, the fourth layer Su4 is thinner than each of the first layer Su1, the third layer Su3, and the fifth layer Su5. Therefore, the thickness T of the flow path member 311 can be made smaller as compared with the case where the fourth layer Su4 is thicker than the first layer Su1, the third layer Su3, or the fifth layer Su5.

2. Second Embodiment

Figure 16:
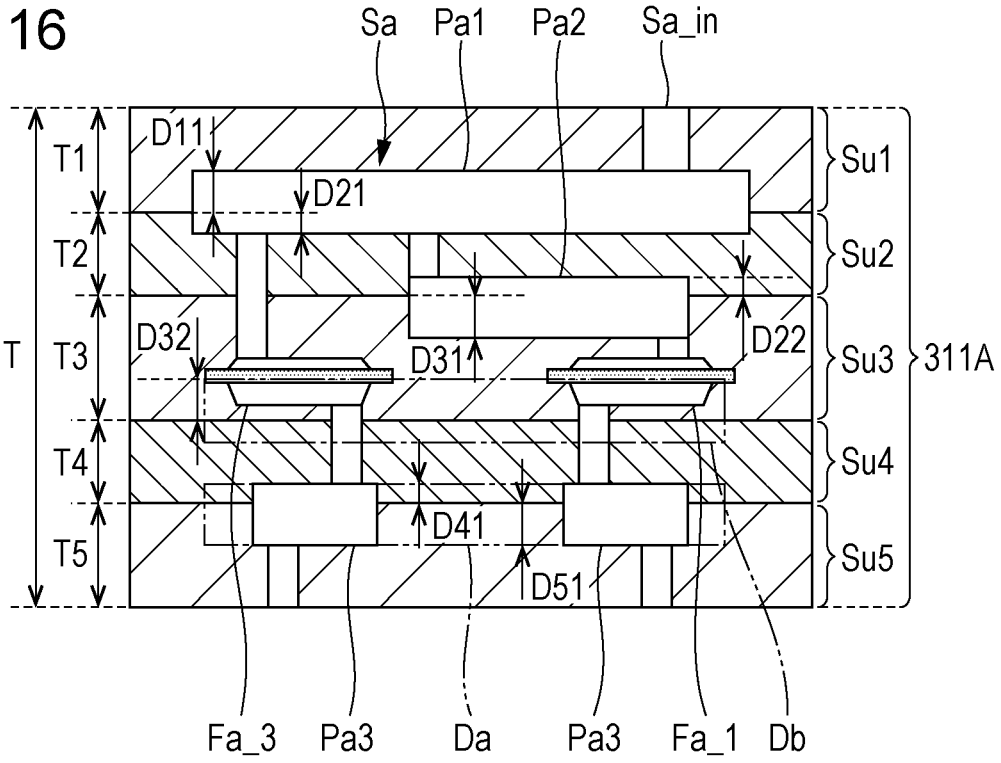
FIG. 16 is a cross-sectional view schematically showing a flow path member according to a second embodiment.

FIG. 16 is a cross-sectional view schematically showing a flow path member 311A according to a second embodiment. In the flow path member 311A, each of the thickness T2 of the second layer Su2 and the thickness T4 of the fourth layer Su4, as well as each of the thickness T1 of the first layer Su1 and the thickness T5 of the fifth layer Su5 is thinner than the thickness T3 of the third layer Su3. That is, it is set as T2, T4<T1, T5<T3. FIG. 10 illustrates a configuration in which the thickness T1 and the thickness T5 are equal to each other and the thickness T2 and the thickness T4 are equal to each other. The thickness T1 and the thickness T5 may be different from each other, and the thickness T2 and the thickness T4 may be different from each other.

As described in the condition D above, the first layer Su1 and the fifth layer Su5 cannot be made smaller than the second layer Su2 and the fourth layer Su4. However, since the first layer Su1 and the fifth layer Su5 are positioned at the ends in the laminating direction, it is sufficient when they have a thickness capable of suppressing the bending that tends to occur, and it does not necessarily have to be thicker than the third layer Su3 in which the filter chamber is provided, or to have the same thickness. On the contrary, when possible, it is desirable to reduce the thickness of the first layer Su1 and the fifth layer Su5 because the entire thickness of the flow path member 311A can be reduced.

In view of the above points, in the present embodiment, the first layer Su1 is thicker than the second layer Su2 but thinner than the third layer Su3. Therefore, the thickness of the entire laminated body constituted by the first layer Su1, the second layer Su2, and the third layer Su3 can be reduced as compared with the case where the first layer Su1 is thicker than the third layer Su3.

From the same viewpoint, the fifth layer Su5 is thicker than the fourth layer Su4 but thinner than the third layer Su3. Therefore, the thickness of the entire laminated body constituted by the third layer Su3, the fourth layer Su4, and the fifth layer Su5 can be reduced as compared with the case where the fifth layer Su5 is thicker than the third layer Su3.

3. Third Embodiment

Figure 17:
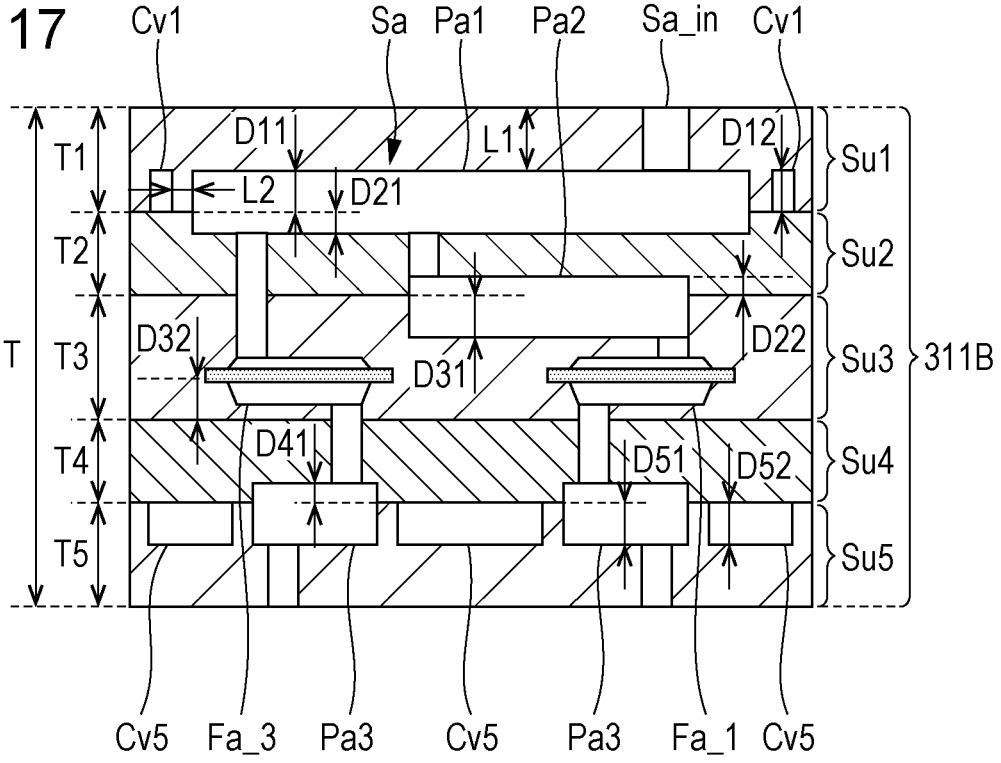
FIG. 17 is a cross-sectional view schematically showing a flow path member according to a third embodiment.

FIG. 17 is a cross-sectional view schematically showing a flow path member 311B according to a third embodiment. In the flow path member 311B, a plurality of cavity portions Cv1 are provided on a surface of the first layer Su1 on the second layer Su2 side. Each of the plurality of cavity portions Cv1 is a recess portion that reduces the uneven wall thickness of the first layer Su1 without being used as a flow path. Similarly, a plurality of cavity portions Cv5 are provided on a surface of the fifth layer Su5 on the fourth layer Su4 side. Each of the plurality of cavity portions Cv5 is a recess portion that reduces the uneven wall thickness of the fifth layer Su5 without being used as a flow path.

Figure 18:
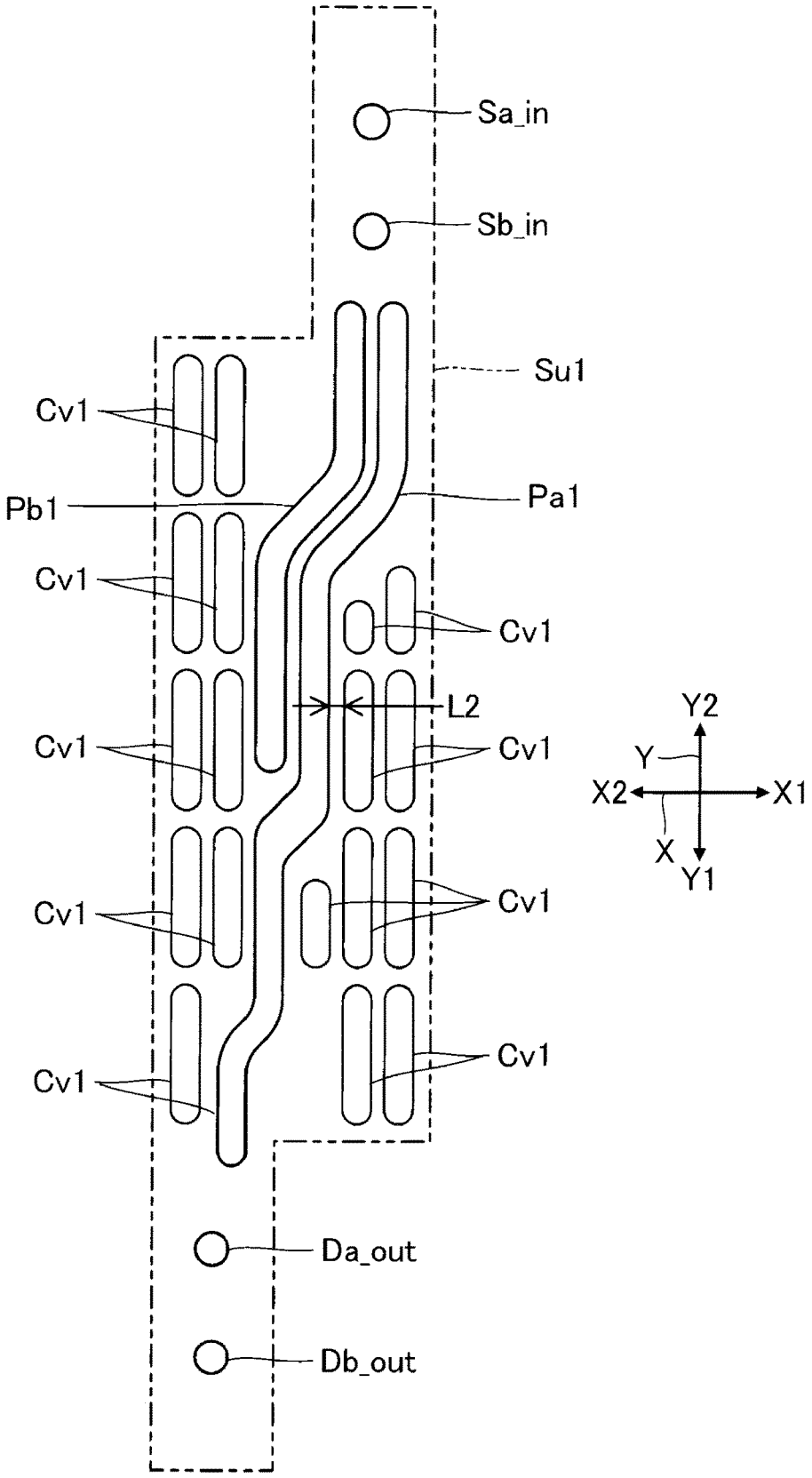
FIG. 18 is a plan view showing a disposition of cavity portions of the flow path member according to the third embodiment.

FIG. 18 is a plan view showing a disposition of cavity portions Cv1 of the flow path member 311B according to the third embodiment. FIG. 18 illustrates a plurality of cavity portions Cv1 dispersedly disposed in a region of the first layer Su1 where the supply portions Pa1 and Pb1 are not provided so as to reduce the uneven wall thickness of the first layer Su1. The shape or disposition of the plurality of cavity portions Cv1 in plan view is not limited to the example shown in FIG. 18. For example, the plurality of cavity portions Cv1 may have a honeycomb shape or the like.

As described above, the cavity portion Cv1 is provided on the surface of the first layer Su1 on the second layer Su2 side instead of the ink flow path. Therefore, it is possible to reduce the bending due to the uneven wall thickness of the first layer Su1.

It is desirable that the depth D11 of the supply portions Pa1 and Pb1 in the first layer Su1 and the depth D12 of the cavity portion Cv1 are equal to each other. Specifically, the ratio of the depth D11 and the depth D12 is desirably 0.8 or more and 1.2 or less, and more desirably 0.9 or more and 1.1 or less. In this case, as compared with the case where the depth D11 of the supply portions Pa1 and Pb1 and the depth D12 of the cavity portion Cv1 in the first layer Su1 are different from each other, it is easy to reduce the bending due to the uneven wall thickness of the first layer Su1.

Further, it is desirable that the distance L1 between the surface of the first layer Su1 opposite to the second layer Su2 and the cavity portion Cv1 is longer than the distance L2 between the supply portions Pa1 and Pb1 of the first layer Su1 and the cavity portion Cv1, and it is more desirable that the distance L1 is 1.8 times or more and 2.2 times or less long than the distance L2. In this case, as compared with the case where the relationship of these distances is the opposite, it is easy to reduce the bending due to the uneven wall thickness of the first layer Su1.

4. Modification Example

The form illustrated above may be variously modified. A specific aspect of modification that can be applied to the above-described embodiments is illustrated below. Any two or more aspects selected from the following examples can be appropriately combined within a range not inconsistent with each other.

1. In the above-described embodiment, the number of circulation heads Hn included in one head unit 252 is four, but the number of circulation heads Hn included in one head unit 252 may be three or less or five or more.

2. In the above-described embodiment, the plurality of head units 252 supported by the support body 251 have the same configuration, but the configuration of the head unit 252 corresponding to the first head unit and the configuration of the head unit 252 corresponding to the second head unit may be different from each other.

3. In the above embodiment, different kinds of ink are supplied to the supply flow path Sa and the supply flow path Sb, but the same kind of ink may be supplied to the supply flow path Sa and the supply flow path Sb.

4. In the above-described embodiment, the sub tank 13 is provided outside the head unit 252, and the ink is circulated between the head unit 252 and the sub tank 13, but instead of the sub tank, any system may be used as long as the system circulates ink between the head unit 252 and the outside of the head unit 252. For example, the ink may be circulated between the head unit 252 and the liquid container 12.

5. In the above-described embodiment, the serial type liquid discharging apparatus in which the transporting body 241 having the head unit 252 mounted thereon is reciprocated has been exemplified, but the present disclosure can be applied to a line type liquid discharging apparatus in which a plurality of nozzles N are distributed over the entire width of the medium 11.

6. The liquid discharging apparatus exemplified in the above-described embodiment can be adopted not only in an apparatus dedicated to printing but also in various apparatus such as a facsimile apparatus and a copying machine. Moreover, the application of the liquid discharging apparatus is not limited to printing. For example, a liquid discharging apparatus that discharges a solution of a coloring material is utilized as a manufacturing apparatus that forms a color filter of a display apparatus such as a liquid crystal display panel. Further, a liquid discharging apparatus that discharges a solution of a conductive material is utilized as a manufacturing apparatus that forms wiring or electrodes of a wiring substrate. Further, a liquid discharging apparatus that discharges a solution of an organic substance related to a living body is utilized, for example, as a manufacturing apparatus that manufactures a biochip.

7. The circulation head Hn illustrated in the above-described embodiment is formed by laminating a plurality of substrates, which are not shown in the figure, but the above-mentioned each component of the circulation head Hn is appropriately provided. For example, the nozzle row La and the nozzle row Lb are provided on a nozzle substrate. The liquid storage chamber Ra and the liquid storage chamber Rb are provided on a reservoir substrate. The plurality of pressure chambers Ca and the plurality of pressure chambers Cb are provided on a pressure chamber substrate. The plurality of driving elements Ea and the plurality of driving elements Eb are provided on an element substrate. One or more of the above nozzle substrate, reservoir substrate, pressure chamber substrate, and element substrate are individually provided for each circulation head Hn. For example, when the nozzle substrate is provided individually for each circulation head Hn, one or more of the reservoir substrate, the pressure chamber substrate, and the element substrate may be commonly provided for the plurality of circulation heads Hn in the head unit 252. Further, when the reservoir substrate and the pressure chamber substrate are individually provided for each circulation head Hn, the nozzle substrate or the like may be provided commonly for the plurality of circulation heads Hn in the head unit 252. Furthermore, the driving circuits for driving the plurality of driving elements Ea and the plurality of driving elements Eb may be provided individually for each circulation head Hn, or may be provided commonly for the plurality of circulation heads Hn in the head unit 252.

What is claimed is:

1. A liquid discharging head unit comprising:

a flow path member formed by laminating a plurality of layers and through which a liquid flows; and a liquid discharging head that is supplied with the liquid from the flow path member and discharges the liquid, wherein the plurality of layers include a first layer that is an outermost layer among the plurality of layers in a laminating direction, a second layer that is laminated on the first layer, and a third layer that is laminated on the second layer on a side opposite to the first layer, a first flow path is provided between the first layer and the second layer, a second flow path is provided between the second layer and the third layer, a filter chamber is provided inside the third layer, and the second layer is thinner than each of the first layer and the third layer.

2. The liquid discharging head unit according to claim 1, wherein the first layer is thinner than the third layer.

3. The liquid discharging head unit according to claim 1, wherein the plurality of layers further include a fourth layer that is laminated on the third layer on a side opposite to the second layer and a fifth layer that is laminated on the fourth layer on a side opposite to the third layer and is an outermost layer among the plurality of layers in the laminating direction, a third flow path is provided between the third layer and the fourth layer, a fourth flow path is provided between the fourth layer and the fifth layer, and the second layer is thinner than the fifth layer.

4. The liquid discharging head unit according to claim 3, wherein the fourth layer is thinner than each of the first layer, the third layer, and the fifth layer.

5. The liquid discharging head unit according to claim 4, wherein the fifth layer is thinner than the third layer.

6. The liquid discharging head unit according to claim 1, wherein a surface of the first layer on the second layer side is provided with a cavity portion that is not a liquid flow path.

7. The liquid discharging head unit according to claim 6, wherein a depth of the first flow path of the first layer and a depth of the cavity portion are equal to each other.

8. The liquid discharging head unit according to claim 6, wherein a distance between a surface of the first layer opposite to the second layer and the cavity portion is longer than a distance between the first flow path of the first layer and the cavity portion.

9. The liquid discharging head unit according to claim 3, wherein each of the first flow path and the second flow path is a supply flow path for supplying the liquid to the liquid discharging head.

10. The liquid discharging head unit according to claim 9, wherein each of the third flow path and the fourth flow path is an exhaust flow path for exhausting the liquid from the liquid discharging head.

11. The liquid discharging head unit according to claim 1, further comprising:

a first liquid discharging head; and a second liquid discharging head different from the first liquid discharging head, wherein each of the first liquid discharging head and the second liquid discharging head is the liquid discharging head.

12. A liquid discharging apparatus comprising:

the liquid discharging head unit according to claim 1; and a control portion controlling a discharging operation from the liquid discharging head unit.

* * * * *